United States Patent [19]

Jones

[11] 4,169,454

[45] Oct. 2, 1979

[54] COMBINATION OF AN ARCHERY BOW, BOW STABILIZER AND ARROW HEAD EXTRACTOR

[76] Inventor: Lonnie M. Jones, 7678 Kress Dr., Klamath Falls, Oreg. 97601

[21] Appl. No.: 880,627

[22] Filed: Feb. 23, 1978

[51] Int. Cl.[2] ..... F41B 5/00

[52] U.S. Cl. ..... 124/23 R; 124/89; 273/106.5 B

[58] Field of Search ..... 124/89, 24 R, 23 R, 124/1; 273/106.5 B, 102 B

[56] References Cited

U.S. PATENT DOCUMENTS

| | | | |
|---|---|---|---|
| 2,684,852 | 7/1954 | Romeka | 273/106.5 B |
| 3,524,441 | 8/1970 | Jeffery | 124/89 X |
| 3,628,520 | 12/1971 | Izuta | 124/89 |
| 3,683,883 | 8/1972 | Izuta | 124/89 |
| 3,967,823 | 7/1976 | Youht | 273/106.5 B X |

*Primary Examiner*—Richard C. Pinkham
*Assistant Examiner*—William R. Browne
*Attorney, Agent, or Firm*—Clarence M. Crews

[57] ABSTRACT

A bow conventionally includes a stabilizer which extends forward from the body of the bow and is weighted at its forward end. The head of an arrow shot by such a bow not infrequently becomes lodged in a tree trunk, board or other tough object. In accordance with the present invention, the stabilizer is made to include a head and a stem, such that the stabilizer head can be unscrewed from the stabilizer stem and screwed onto the lodged arrow head, and the stem of the stabilizer can then be unscrewed from the bow and passed through an opening in the stabilizer head for rocking and/or twisting the arrow head free of the tree or other object in which it is lodged.

3 Claims, 7 Drawing Figures

COMBINATION OF AN ARCHERY BOW, BOW STABILIZER AND ARROW HEAD EXTRACTOR

It is common practice to provide a bow with a weighted stabilizer to prevent, or at least to reduce, the shifting of the bow and the consequent pointing of the arrow off target in response to the shock occasioned by the release of the bow string.

The arrow ordinarily consists of a relatively fragile hollow aluminum shaft and a metallic head screw threaded into the shaft. When an arrow becomes lodged in a solid object such as a tree trunk, the shaft can be readily retrieved by unscrewing it from the arrow head. The head, however, generally represents more than half of the cost of the complete arrow. It is very desirable, therefore, to provide means for recovering the arrow head.

To this end, I have revised the bow stabilizer, which is always conveniently at hand, for temporarily converting it to serve as an arrow head extractor.

The stabilizer stem is made separable both from the bow and from the stabilizer head. The detached stabilizer head is screwed onto the embedded arrow head in place of the unscrewed arrow stem and the stabilizer stem is unscrewed from the bow, thrust through a transverse opening in the stabilizer head, and used as a lever for prying and/or rocking the arrow head to loosen the arrow head.

Other objects and advantages will hereinafter appear.

In the drawing forming part of this specification,

Figure 1:
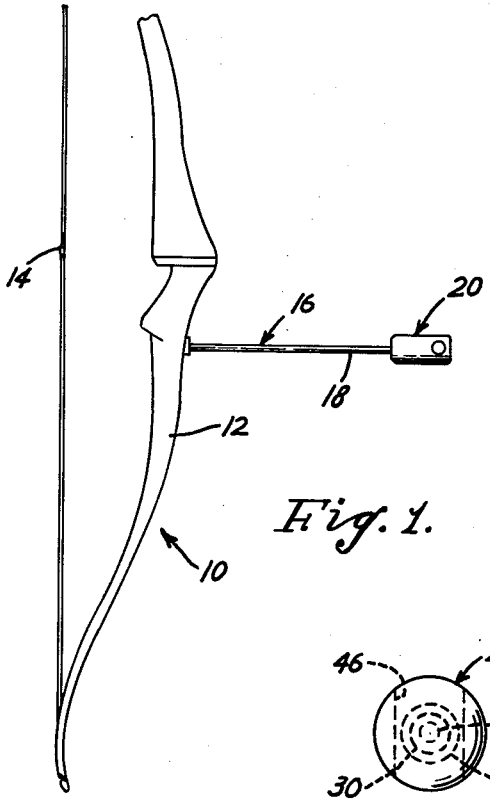
FIG. 1 is a fragmentary view in side elevation of a bow which is equipped with a two-part stabilizer.
Figure 3:
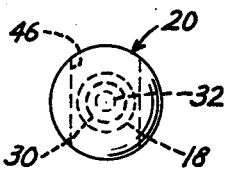
FIG. 3 is an end view of the stabilizer as seen from above in FIG. 2.
Figure 4:
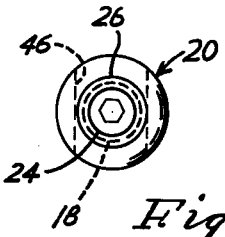
FIG. 4 is an end view of the detached stabilizer as seen from the lower end in FIG. 2.
Figure 2:
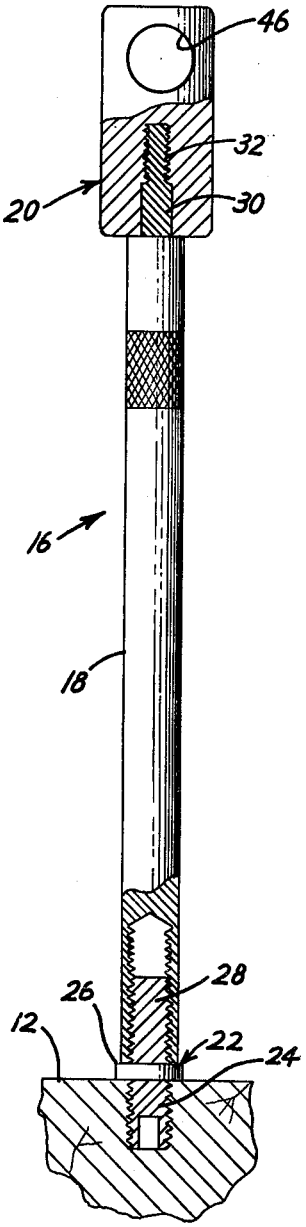
FIG. 2 is a view in elevation, partly broken away, of the stabilizer and a small fragment of the bow.
Figure 5:
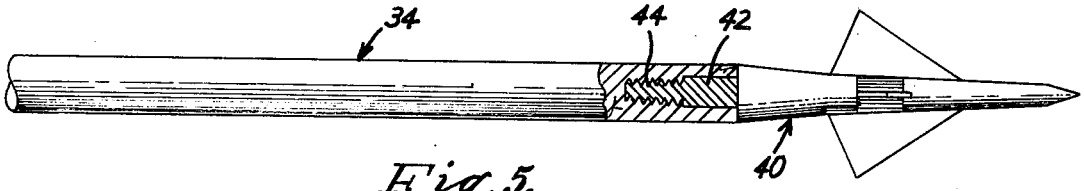
FIG. 5 is a fragmentary view, partly broken away, showing the arrow head and the forward end of the arrow shaft.
Figure 6:
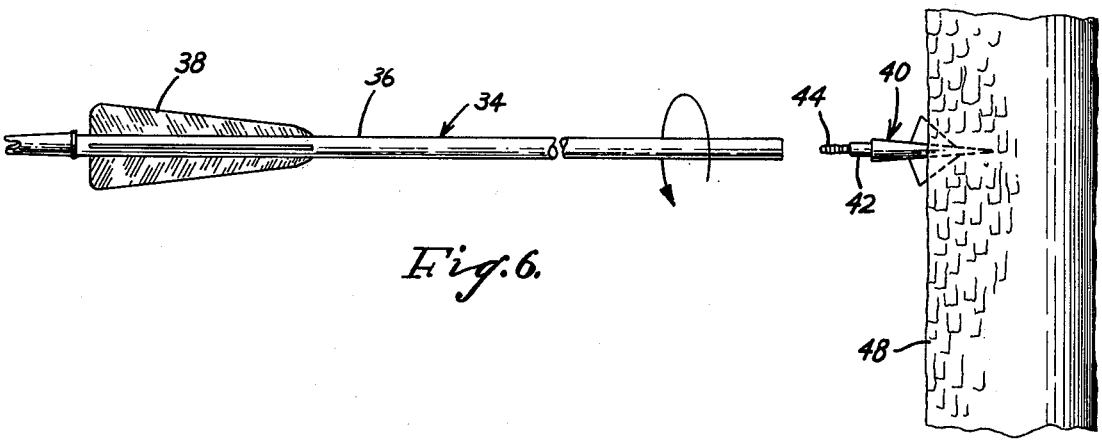
FIG. 6 shows the arrow head lodged in a tree or log and the detached but aligned arrow shaft broken away intermediate its ends.
Figure 7:
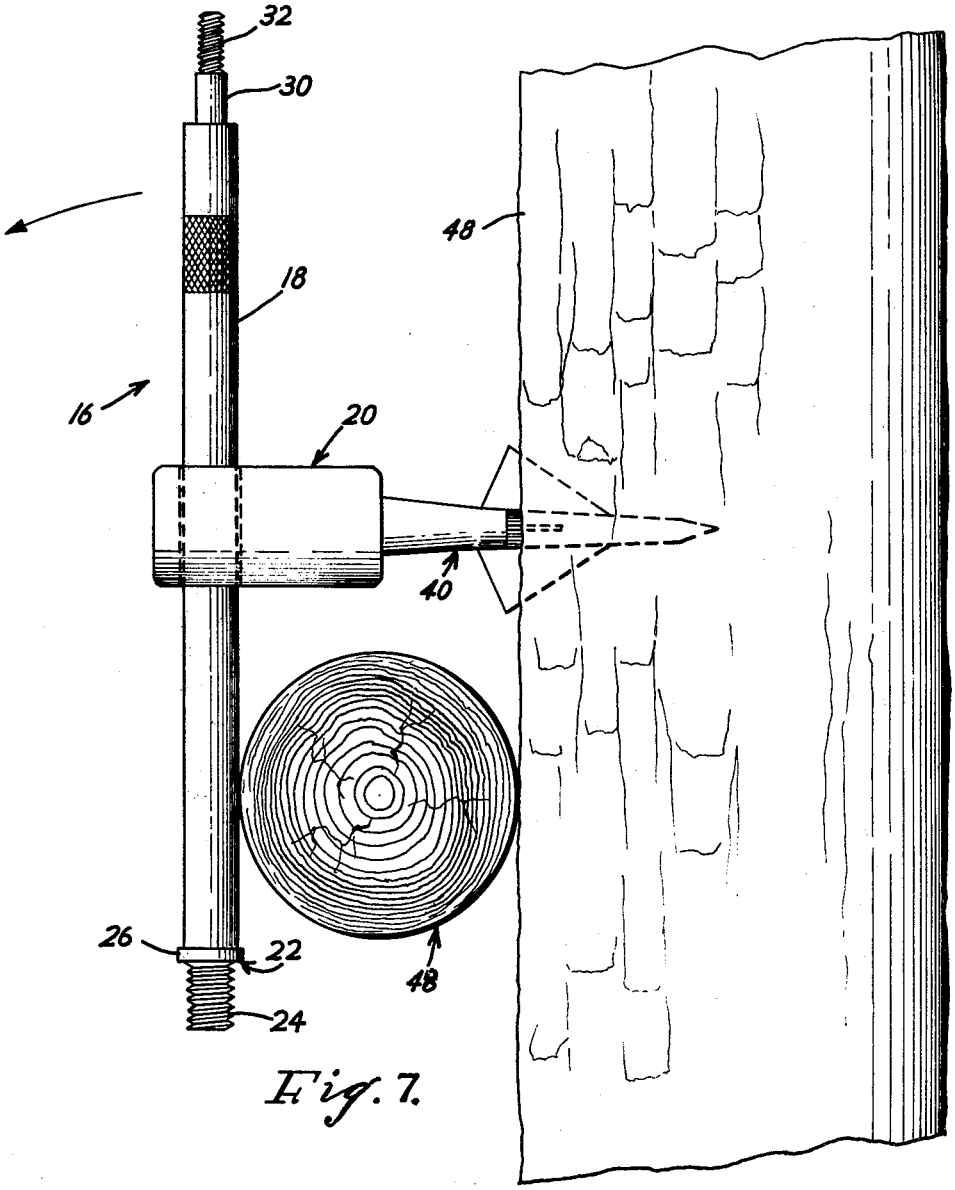
FIG. 7 shows the arrow head lodged in a log, the stabilizer head screwed onto the arrow head, and the stabilizer stem thrust transversely through the stabilizer head.

As shown in FIG. 1, the bow 10 is conventional in form, consisting of a flexible and elastic bow member 12 and a bow string 14 through which the ends of the member 12 are connected under stress to one another. The member 12 has detachably affixed to it a stabilizer 16. The stabilizer 16 comprises a stem portion 18 and a head portion 20. The stem portion 18 is normally joined to the bow member 12 through a connector 22. The connector 22 has a threaded end portion 24, a collar 26 and a threaded end portion 28. The portion 24 is threaded for its full length into the bow member 12 so that the collar 26 abuts the member 12. The stem portion 18 is normally threaded completely home on a threaded portion 28 of the member 22. The member 18, at its forward end, has a shouldered segment 30 and a threaded end segment 32, both of which segments normally fit snugly into the stabilizer head 20.

The stabilizer head 20 has a transverse bore of greater diameter than the stabilizer stem 18, which allows lever action.

Each arrow 34 comprises a shaft portion 36 which includes a fixed, feathered tail portion 38, together with a detachable head portion 40.

The arrow head 40 is pointed at its forward end. At its rear end it terminates in a shouldered portion 42 and a reduced threaded portion 44, these portions being identical dimensionally with the shouldered portion 30 and the threaded portion 32 of the stabilizer stem portion 18.

Because the stabilizer shaft portions 30 and 32 are identical, respectively, with the arrow head portions 42 and 44, the arrow stem 34 can be unscrewed from the entrapped arrow head and be replaced by the stabilizer head 20, when it becomes necessary to dislodge an arrow head from a solid body such as a tree trunk. The stabilizer shaft 18, which is desirably of steel construction, can then be unscrewed from the bow member 12, thrust slidably through a cross-bore 46 provided in the stabilizer head 20, and used first as a lever for prying and/or rocking the arrow head, and then as a handle for withdrawing the arrow head. The collar 26 prevents the stabilizer stem from being pulled accidentally clear of the stabilizer head 20 when the latter is impaled on the stem 18. A loose tree branch 48 can desirably be used as a fulcrum between the tree trunk and the stabilizer stem 18.

The extracted arrow head is then reunited with its shaft, and the stabilizer shaft 18 is reunited with the bow member 12 and with the stabilizer head 20.

I claim:

1. The combination with a stabilizer equipped bow of an arrow having a shaft and a separable head, the bow stabilizer including a shaft detachably connected to the bow and a head detachably connected to the stabilizer shaft, the stabilizer head being interchangeably connectible to the stabilizer shaft and to the arrow head, and the stabilizer head being formed with a cross-bore through which the stabilizer shaft, when detached from the bow, may be inserted for extracting the arrow head from an unintended target.

2. The combination of claim 1 in which the stabilizer shaft is of smaller diameter than the cross-bore of the stabilizer head.

3. The combination of claim 2 in which the stabilizer includes a member having one end normally threaded into the stabilizer shaft and an opposite end normally threaded into the bow and an intervening collar, a collar serving, when the stabilizer head is slidably impaled on the stabilizer stem, to prevent the stabilizer head from dropping off of the stabilizer shaft at the end of the shaft at which the collar is located.

* * * * *